United States Patent [19]

Ishikawa et al.

[11] Patent Number: 4,902,991

[45] Date of Patent: Feb. 20, 1990

[54] RADIO FREQUENCY SIGNAL COMBINING/SORTING DEVICE

[75] Inventors: Youhei Ishikawa, Kyoto; Hidekazu Wada, Kobe; Koichi Takehara, Osaka; Shigeji Arakawa, Ibaraki; Toru Tanizaki, Kyoto, all of Japan

[73] Assignee: Murata Manufacturing Co., Ltd., Japan

[21] Appl. No.: 166,111

[22] Filed: Mar. 10, 1988

[30] Foreign Application Priority Data

Mar. 12, 1987 [JP] Japan ..... 62-57455

[51] Int. Cl.[4] ..... H01P 1/212

[52] U.S. Cl. ..... 333/126; 333/134

[58] Field of Search ..... 333/126, 129, 134, 135; 455/78, 80, 82, 83; 370/25, 32, 38

[56] References Cited

U.S. PATENT DOCUMENTS

| | | | |
|---|---|---|---|
| 2,419,557 | 4/1947 | Friis | 333/134 |
| 3,068,428 | 12/1962 | Alford et al. | 333/126 |
| 4,080,601 | 3/1978 | Alcorn, Jr. | 370/38 |
| 4,186,359 | 1/1980 | Kaegebein | 333/134 |
| 4,375,622 | 3/1983 | Hollingsworth et al. | 333/126 |
| 4,614,920 | 9/1986 | Tong | 333/135 |
| 4,644,303 | 2/1987 | Jachowski et al. | 333/134 |
| 4,646,038 | 2/1987 | Wanat | 333/202 |
| 4,667,172 | 5/1987 | Longshore et al. | 333/134 |

FOREIGN PATENT DOCUMENTS 2188789 4/1987 United Kingdom .

*Primary Examiner*—Eugene R. LaRoche
*Assistant Examiner*—Benny Lee
*Attorney, Agent, or Firm*—Ostrolenk, Faber, Gerb & Soffen

[57] ABSTRACT

A radio frequency signal combining/sorting device which includes a plurality of filters, and a duplexer device connected to one side of input/output sides of each of the filters for combining/sorting signals, and is characterized in that there is provided a coupling device formed at the input/output ends of the filter connected side of the duplexer means device, with the filters being formed, at their side connected to the duplexer device, with openings for receiving the coupling device.

4 Claims, 2 Drawing Sheets

RADIO FREQUENCY SIGNAL COMBINING/SORTING DEVICE

BACKGROUND OF THE INVENTION

The present invention generally relates to communication equipment and more particularly, to a radio frequency signal combining/sorting device.

The radio frequency signal combining/sorting device referred to in connection with the present invention includes an antenna sharing device, diplexer, a duplexer, unit exclusively for sorting, or a unit exclusively for combining, etc., and hereinafter, will be described with reference to a transmitter multiplexer as an example.

Conventionally, in an antenna sharing device at a base station for an automobile telephone or the like, it has been a practice to compose a plurality of frequency signals by means of a transmitter multiplexer for transmission from one antenna through an antenna line, and for such a transmitter multiplexer there has been available an arrangement, for example, as shown in FIG. 3, which includes a plurality of channel filters 30 (two channel filters are shown in FIG. 3) respectively having different resonance frequency signals, and a duplexer means 31.

In the above known arrangement, for the channel filters 30, for example, magnetic coupling type $TE_{01}\delta$ dielectric resonators and the like are employed, with coupling loops 32 disposed within the resonators and externally led out therefrom through connectors 33. On the other hand, in the duplexer means 31 through which a composite transmission line 34 extends, connectors 35 are provided for connection with the connectors 33 referred to above, and these connectors 35 are connected to the composite transmission line 34 through an individual transmission line 36.

For these connectors 33 and 35, push-on type connectors, etc. are employed to facilitate connection therebetween, whereby both of the connectors 33 and 35 are arranged to be connected to each other by inserting the connectors 33 of the respective channel filters 30 into the connectors 35 of said duplexer means 31.

However, the conventional transmitter multiplexer explained so far has problems as described hereinbelow.

Specifically, since the channel filters 30 and the duplexer means 31 are mechanically connected to each other by the connectors 33 and 35, contact resistance is present at portions of such connectors. Therefore, joule loss is caused by the contact resistance, etc. at such connector portions, and the electrical characteristics of the device undesirably impaired.

There are certain desirable characteristics for an electrical length of the individual transmission line 36 from a junction of the composite transmission line 34 and the individual transmission line 36 in the duplexer means 31, i.e., from a so-called junction point 37 including the coupling loops 32. This electrical length should preferably be stable at ¼ wavelength, i.e., an electrical angle of 90 degrees, on the assumption that the channel filters 30 are not coupled with the duplexer means 31 at the required center frequency of the frequency band region of the transmission sharing device. However, the problem exists that this electrical length becomes unstable and undesirably scatters (varies unpredictably), depending on the state of connection at the connector portions.

Such problems as described above arise in other radio frequency signal composing/sorting devices as well.

SUMMARY OF THE INVENTION

Accordingly, an essential object of the present invention is to provide an improved radio frequency signal combining/sorting device, which is capable of preventing impairment of electrical characteristics by reducing a transmission loss caused by the connection between the filters and duplexer means, and also, preventing scattering in the electrical length and thereby reducing a scattering loss.

Another object of the present invention is to provide a radio frequency signal combining/sorting device of the above described type which is simple in construction and stable in functioning, and can be readily incorporated into various communication equipment at low cost.

In accomplishing these and other objects, according to one preferred embodiment of the present invention, there is provided a radio frequency signal combining/sorting device which includes a plurality of filters, and a duplexer means connected to one side of input/output sides of each of said filters for combining/sorting signals thereof, and is characterized in that there is provided a coupling means formed at the input/output ends of the side of said duplexer means having the filter connected thereto, with said filters being formed, at the side thereof connected to said duplexer means, with an opening means for receiving said coupling means.

By the above construction of the present invention, since the coupling means formed in the duplexer means is inserted into the opening means at the side connected to the radio frequency signal composing/sorting device, of the filters, there is no contact resistance present therebetween, and thus, the undesirable reduction in the electrical characteristics, instability of the electrical length for scattering, etc. may be advantageously eliminated.

BRIEF DESCRIPTION OF THE DRAWINGS

These and other objects and features of the present invention will become clear from the following description of preferred embodiments thereof with reference to the accompanying drawings, in which.

DETAILED DESCRIPTION OF THE INVENTION

Figure 1:
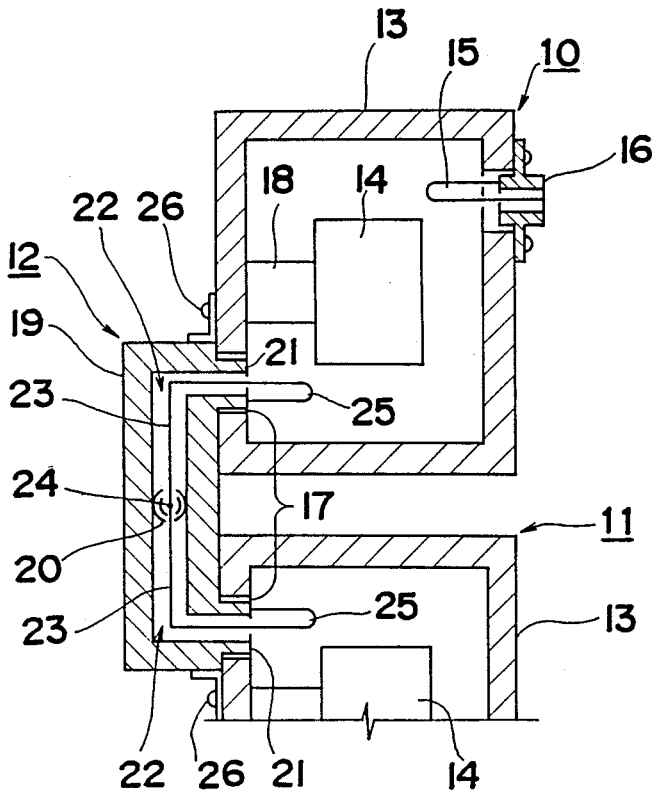
FIG. 1 is a fragmentary sectional view showing construction of a radio frequency signal combining/sorting device according to one preferred embodiment of the present invention.

Before the description of the present invention proceeds, it is to be noted that like parts are designated by like reference numerals throughout the accompanying drawings.

Figure 2:
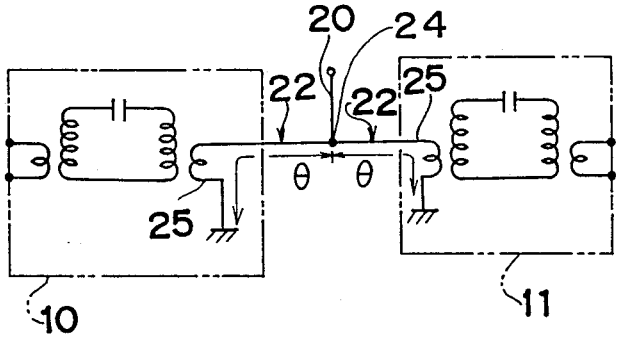
FIG. 2 is an electrical diagram showing an equivalent circuit of the radio frequency signal combining/sorting device of FIG. 1.
Figure 3:
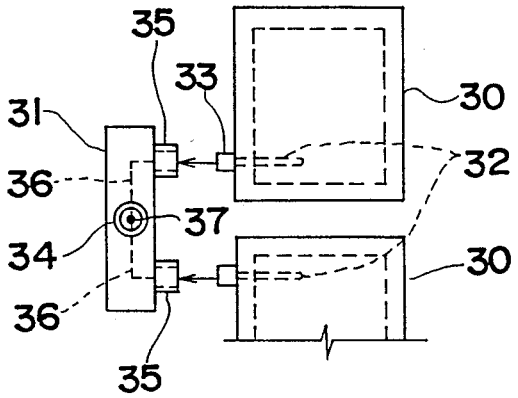
Fig. 3 PRIOR ART
FIG. 3 is a fragmentary top plan view showing construction of a conventional radio frequency signal combining/sorting device (already referred to).

Referring now to the drawings, there is shown in FIG. 1, a radio frequency signal combining/sorting device in the form of a transmitter multiplexer according to one preferred embodiment of the present invention, with an equivalent circuit thereof being shown in FIG. 2. The radio frequency signal combining/sorting device in FIG. 1 generally includes a plurality of filters (10, 11), and a duplexer means (12) connected to one side of input/output sides of each of said filters (10, 11) for combining/sorting signals thereof, and is characterized in that there is provided a coupling means formed at the input/output ends of the side of said duplexer means (12) connected to the filter, with said filters (10, 11) being formed, at the side thereof connected to said duplexer means (12), with openings (17) for receiving said coupling means.

For each of the channel filters 10 and 11, a $TE_{01}\delta$ dielectric resonator of a magnetic coupling type constituted by a dielectric resonator element 14 supported within a shield casing 13 by means of a support member 18 is used, with a coupling loop 15 serving for its input terminal being led outside by a connector 16. Meanwhile, the shield casings 13 are formed with the openings 17 at positions thereof where coupling loops serving as output terminals thereof are provided.

It should be noted here that the resonators to be used for the filters as referred to above are not limited to those described in the foregoing embodiment, but the filters 10 and 11 may for example, be constituted by semi-coaxial resonators, or $TM_{010}$ mode resonators, etc.

The duplexer 12 includes a block 19 in a rectangular prism shape made of metallic material or the like, and at a central portion of said block 19, a composite transmission line 20 extending vertically therethrough (i.e., in a direction perpendicular to the surface of the paper on which FIG. 1 is drawn) at its central portion is provided. This composite transmission line 20 is made of a coaxial cable, and is connected to an antenna (not shown). On side faces at opposite ends of the block 19, fitting projections 21 to be detachably engaged with the openings 17 of the channel filters 10 and 11 are formed, while an individual transmission line 22 extending through the block 19 is formed between the fitting projections 21. A central conductor 23 of the individual transmission line 22 is connected, at its central position, with a corresponding central conductor of the composite transmission line 20 so as to form a junction point 24. The opposite ends of the central conductor 23 extend outwardly through the respective fitting projections 21, and the respective opposite ends of said central conductor 23 are formed into coupling loops 25 which serve as output coupling means for the respective channel filters 10 and 11. In the above case, the electrical length of the individual transmission lines 22 from the junction point 24 including the coupling loops 25 is set at $\frac{1}{4}$ wavelength, i.e., at an electrical angle $\theta$ shown in FIG. 2 of 90 degrees, on the assumption that the channel filters 10 and 11 are not coupled with the duplexer means 12 at the required center frequency band of the transmitter multiplexer.

It is to be noted here that, in the embodiment of FIG. 1, although one coupling loop 25 is formed for each of the channel filters, the construction is not limited to the above, and may be so modified, for example, that more than two coupling loops are formed in parallel relation respectively for connection with the respective ends of the central conductor 23 in order to shorten the electrical length.

The fitting projections 21 of the duplexer means 12 are respectively fitted into the openings 17 of the channel filters 10 and 11, with both being connected, for example, by screws 26 for achieving conduction for grounding and mechanical fixing, whereby the coupling loops 25 extending outwardly from the fitting projections 21 of the duplexer means 12 are respectively inserted into the channel filters 10 and 11.

As is clear from the foregoing description, according to the present invention, since the output side coupling means 25 of the channel filters is formed at the forward ends of the individual transmission line 22 connected to the composite transmission line 20 of the duplexer means (loop) 12 and the couplig means 25 is directly inserted into the channel filters 10 and 11 through the fitting portions therebetween (openings 17 and fitting projections 21), it becomes unnecessary to provide the connectors as in the conventional arrangements between the duplexer means and channel filters, and the undesirable contact resistance caused by such connectors can be eliminated. Therefore, there is no possibility that the electrical characteristics are lowered or electrical length becomes unstable and scatters by such contact resistance.

It should be noted here that the present invention is not limited, in its application, to the radio frequency signal composing/sorting device as described in the foregoing embodiment alone, but may also be applied, for example, to an antenna sharing device which commonly uses one antenna both for transmission and reception, a diplexer, a duplexer, a unit exclusively for sorting, or a unit exclusively for combining, to be applied to an end use different from the transmission sharing as described in the embodiment.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A radio frequency signal combining/sorting device which comprises a plurality of filters, each filter having a different resonant frequency and having at least one respective input/output connector means; and duplexer means connected to said at least one connector means of each said filter for combining/sorting signals carried by said connector means;

said duplexer means comprising a unitary metallic block substantially in the shape of a rectangular prism, said block having a unitary outer metallic casing means which is securable to and removable from said filters, and said block defining a lengthwise direction and a transverse direction substantially perpendicular thereto;

said duplexer means further comprising composite transmission line means therein and comprising a coaxial cable which is connectable with an antenna, said coaxial cable extending transversely out of said block from a junction point located substantially at the lengthwise middle of said block;

each of said filters comprising a casing defining a resonant cavity therein; and said input/output connector means of each said filter to which said duplexer means is securable comprising an opening formed in said casing communicating with said resonant cavity; said block having at least a pair of fitting projections both extending in a common direction therefrom, each defining a central aperture and being sized and shaped to releasably fit in said openings in said filters; means for securing said outer metallic casing means of said block to said filters with said fitting projections fitted into said openings in said filters; said apertures in said fitting projections thereby communicating with said resonant cavities via said openings;

said duplexer means further comprising a respective individual transmission line which extends from each said fitting projection to said junction point via the interior of the block and is physically and electrically isolated from said block;

each said individual transmission line further comprising a continuous central conductor which is connected to a central conductor of said coaxial cable at said junction point;

said continuous central conductors of said individual transmission lines also extending continuously out of the interior of said block at said respective fitting projections, and being formed into respective coupling loops extending into said resonant cavity, thereby coupling said filters to said composite transmission line means when said block is secured to said filters.

2. A device as in claim 1, wherein the length of said fitting projections extending out of said block is substantially equal to the wall thickness of said filter casing, so that said fitting projections engage said filter casing without substantially projecting into said filter casing.

3. A device as in claim 1, wherein the electrical length of each of the individual transmission lines including the coupling loops is substantially one-quarter wavelength at substantially the center of a frequency band which includes said filter frequencies.

4. A device as in claim 1, wherein said input/output connector means of said filters, to which said duplexer means is connected, are output connector means of said filters.

* * * * *